United States Patent [19]

Babendererde et al.

[11] Patent Number: 4,848,963

[45] Date of Patent: Jul. 18, 1989

[54] EARTH PRESSURE SHIELD

[75] Inventors: Siegmund Babendererde, Bad Vilbel; Hans-Jürgen Flunker; Gert Wittneben, both of Essen; Otto Braach, Wesel, all of Fed. Rep. of Germany

[73] Assignee: Hochtief Aktiengesellschaft vorm. Gebr. Helfmann, Essen, Fed. Rep. of Germany

[21] Appl. No.: 157,848

[22] Filed: Feb. 18, 1988

[51] Int. Cl.[4] ..... E21D 9/08

[52] U.S. Cl. ..... 405/144; 405/141; 299/33; 299/56; 299/58

[58] Field of Search ..... 405/132, 138, 141, 144; 299/55, 56, 33, 58

[56] References Cited

U.S. PATENT DOCUMENTS

| | | | |
|---|---|---|---|
| 3,266,257 | 10/1966 | Larrouze | 299/56 X |
| 4,040,666 | 10/1977 | Uchida et al. | 405/141 X |
| 4,068,485 | 1/1978 | Stuckman et al. | 405/141 |
| 4,165,129 | 8/1979 | Sugimoto et al. | 405/141 X |
| 4,436,448 | 3/1984 | Magnus et al. | 405/143 |
| 4,607,889 | 8/1986 | Hagimoto et al. | 299/56 X |
| 4,629,255 | 12/1986 | Badendererde | 299/56 X |
| 4,729,693 | 3/1988 | Hentschel | 405/144 |

FOREIGN PATENT DOCUMENTS

| | | | |
|---|---|---|---|
| 93519 | 5/1897 | Fed. Rep. of Germany | 405/141 |
| 1203301 | 10/1965 | Fed. Rep. of Germany | 299/33 |
| 1222099 | 8/1966 | Fed. Rep. of Germany | 405/132 |
| 2245501 | 4/1974 | Fed. Rep. of Germany | 405/141 |
| 3118523 | 12/1982 | Fed. Rep. of Germany | 405/141 |
| 3418180 | 1/1986 | Fed. Rep. of Germany | 299/33 |
| 3446895 | 7/1986 | Fed. Rep. of Germany | 405/144 |
| 3622851 | 1/1988 | Fed. Rep. of Germany . | |
| 3623553 | 1/1988 | Fed. Rep. of Germany . | |
| 1406276 | 10/1975 | United Kingdom | 405/144 |
| 2029477 | 3/1980 | United Kingdom | 405/141 |
| 2177741 | 1/1987 | United Kingdom | 405/141 |

OTHER PUBLICATIONS

"Beton- und Stahlbetonbau", 6/1986, pp. A17–A18.
"Tunnels & Tunnelling", Jan. 1986, pp. 28 and 29.
"100 Jahre Firma Wayss & Freytag Hydroschild", pp. 250–256.
"Schweizer Ingenieur und Architekt" 42/1980, pp. 1028–1031.
"Tunnels & Tunnelling", Feb. 1983, p. 65.

*Primary Examiner*—Dennis L. Taylor
*Assistant Examiner*—Arlen L. Olsen
*Attorney, Agent, or Firm*—Herbert Dubno

[57] ABSTRACT

The earth pressure shield for a tunnel and/or gallery excavator has a front working compartment formed by a separating wall having a digging tool and an annular reinforcing space substantially triangular in cross section positioned directly in front of the separating wall. So that an extensive restructuring of the machine is not necessary when moving from soft earth to hard ground, the annular reinforcing space is provided with a lower fluid feeder, a controlled upper pressurized air feeder, a plurality of fluid conductor pipes which are guided from below to an upper fluid outlet opening into the working compartment, and a fluid level controller. The invention is based on the consideration that a reliable and satisfactory support of the local front wall is only possible when the local front wall in the vicinity of the roof can be supplied with a fluid.

9 Claims, 2 Drawing Sheets

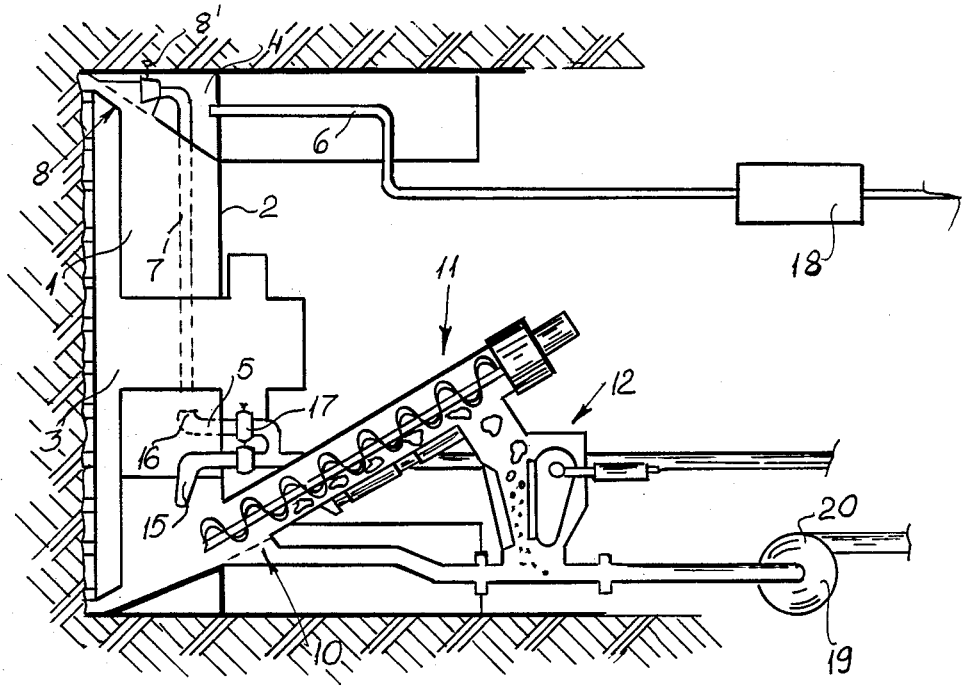
FIG. 3
FIG. 4
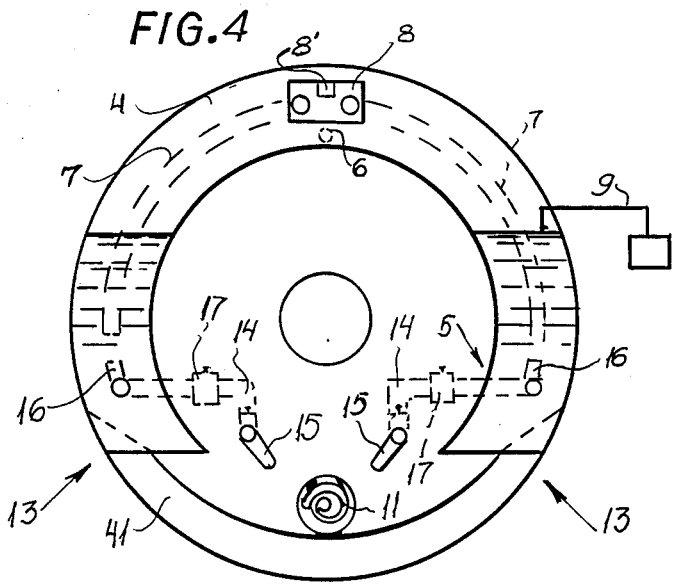

EARTH PRESSURE SHIELD

FIELD OF THE INVENTION

Our present invention relates to an earth pressure shield for a tunnel and gallery digging machine or like subterranean excavator.

BACKGROUND OF THE INVENTION

An earth pressure shield generally has a front working compartment formed by a separating wall having a digging tool and an annular shield-reinforcing or stiffening space substantially triangular in cross section positioned directly in front of the separating wall.

The local front wall of earth facing the digging machine is itself supported with the earth pressure shield in ground of unfirm loose earth which is being dug by the digging wheel and arrives in the working compartment.

From this working compartment only as much earth is removed, mostly with a screw conveyor, as is excavated by the digging wheel.

As a result, the pressure which the loose earth material exerts on the local front wall through the openings in the digging wheel always has a value which is higher than the earth and water pressure due to the load from the ground and ground water. To control the volume balance of the excavated earth and the earth being removed, the forward motion of the shield and the rotary speed of the screw conveyor are monitored and regulated.

In the walls of the working compartment pressure measuring devices are built in which similarly observe the pressure in the working compartment. Special problems arise, however, when the surrounding ground does not have a consistency which corresponds to that of a viscous fluid. Then a reliable pressure transmission in the working compartment can occur only by a fluid so that the local front wall is supported reliably over its entire cross section. Thus the earth pressure shield feeds fluid into the working compartment when the adjacent ground is not very soft.

To supply the supporting fluid especially effectively it should be pumped through a central feeder in the drive axle of the digging wheel and fed through the spikes of the digging wheel into the gap which develop in front of the digging wheel. This feed of fluid is, however, not completely satisfactory, since it does not succeed in maintaining the pressure of the fluid constant, an essential prerequisite for support of the local front wall.

Only the pressure measuring devices in the wall of the working compartment provide regulating impulses for the feed of the fluid. However, these are largely unreliable measuring devices. Also pumps and valves, with which the fluid feed is controlled, are relatively slow control instruments so that large intolerable pressure differences arise.

Moreover, with changing geological requirements for the excavator, it is advantageous to fit the manner in which the local front wall is supported to the particular geology. Thus it is appropriate that in fine grained soft earth which is located under the ground water level, to support the local front wall during the earth excavation by the loose plastic earth alone. The earth loosened by the digging tool or wheel is fed into a working compartment closed off from the shield interior. From the working compartment only as much of the earth is drawn off with a screw conveyor as is excavated in the same time by the digging wheel.

As a result, the pressure which is exerted by the loosened plastic earth material through the openings in the digging tool or wheel on the local front wall always has a value which is higher than the earth and water pressure from the load due to the earth and ground water.

Because of the pressure-stable feed of liquid, particularly in the vicinity of the roof or upper portion of the local front wall, it is guaranteed that the support of the local front wall with the dug or excavated earth material is thus reliable when the earth material does not behave only like a liquid. The support of the local front wall with earth pressure is therefore economical with fine grained soft earth because the soft earth can be fed above ground on delivery of only a little water with a piston pump in a concentrate flow process.

The solid component amounts to up to 70% of the conveyed flow. The separation of the solids from the conveying medium is very expensive with fine grained earth. That can not be avoided, when the earth can be fed with only a small amount of water. Should the geology change to a hard earth formation which does not easily dissolve or break up in water and therefore can not be plasticized easily, then an earth pressure support is not possible with the earth pressure shield known up to now.

If the local front wall must be supported when a soft earth formation arises in the roof, then a liquid, either water or a water suspension, must be pumped into the working compartment for support. The loosened earth material is drawn then from the working compartment with the supporting liquid and is fed above ground in a dilute flow process with a rotary pump and fed to a separating unit. There the solid component amounting to about 10% of the conveyed volume is separated and the supporting liquid again is pumped into the working compartment.

The changing properties of the earth demand different supporting processes for securing the local front wall during the earth excavation and different processes for hydraulic transport of earth materials in tunnel and gallery excavation work. This has required up to now a very difficult restructuring of excavating devices in which the correct time for restructuring in a transition between soft and hard ground layers is somewhat uncertain.

OBJECTS OF THE INVENTION

It is an object of our invention to provide an improved earth pressure shield for a tunnel and/or gallery excavator used in underground excavation work in which the above mentioned disadvantages are avoided.

It is also an object of our invention to provide an improved earth pressure shield for a tunnel and/or gallery excavator used in underground excavation work in which a reliable support of the local front wall of earth can be attained for all types of ground and geological conditions without extensive restructuring.

It is also an object of our invention to provide an improved earth pressure shield for a tunnel and/or gallery excavator used in underground excavation work with which a reliable excavation can proceed in ground having mixed geological properties, especially having areas with soft loose ground and hard rock or earth, without extensive restructuring of the excavator and/or shield.

SUMMARY OF THE INVENTION

These objects and others which will become more readily apparent hereinafter are attained in accordance with our invention in an earth pressure shield with a front working compartment formed by a separating wall having a digging tool and an annular reinforcing space substantially triangular in cross section positioned directly in front of the separating wall.

According to our invention the annular reinforcing space is provided with a lower liquid feeder, a controlled upper pressurized air feeder, a plurality of liquid conductor pipes which extend from below to an upper liquid outlet opening into the working compartment and a liquid level controller. The invention is based on the consideration that a reliable and satisfactory support of the local front wall is only possible when the local front wall in the vicinity of the roof can be supplied with a liquid.

By the "front" we mean in the direction of the digging excavation and hence the direction in which the digging tool acts.

The annular reinforcing space can be connected below the liquid feeder with the working compartment, the upper liquid outlet can be closable and the working compartment can have a liquid delivery device which is adjustable with the one liquid feeder in the annular reinforcing space closed and with the liquid outlet closed. In this way the supporting pressure acting on the local front wall can be kept constant continuously in both working processes.

Also the annular reinforcing space with the triangular cross section which is located directly behind the digging tool and which acts to reinforce the digging tool can be used as a pressure balancing reservoir for the supporting liquid. Also spaces in the steel structure in the rear can be so used or provided.

According to another feature of our invention, the annular space in the lower quadrants have a somewhat reduced cross section and this acts only to reinforce the shield. This portion is closed upwardly at the transition point to the larger cross section so that here either water or earth can be forced in. The larger cross section is open downwardly so that a connection to the working compartment arises.

The upper liquid outlet can be closed with the help of an upper liquid outlet valve which can be a slide or gate valve. The liquid delivery device of the working compartment can have feed device outlets directed downwardly. The liquid feeder in the annular reinforcing space can have feeder outlets directed upwardly.

Advantageously one slider or gate valve can be located upstream of a liquid feeder outlet of the liquid feeder and another slider or gate valve is located upstream of a feed device outlet of the liquid feed device and the one slider or gate valve is coupled with the other slider or gate valve.

BRIEF DESCRIPTION OF THE DRAWING

The above and other objects, features and advantages of our invention will become more readily apparent from the following specific description, reference being made to the accompanying drawing in which:

FIG. 3 is a longitudinal cross sectional view through another embodiment of an earth pressure shield according to our invention; and FIG. 4 is a front elevational view of the shield shown in FIG. 3 taken along line 4—4' with the digging tool removed.

SPECIFIC DESCRIPTION

Figure 1:
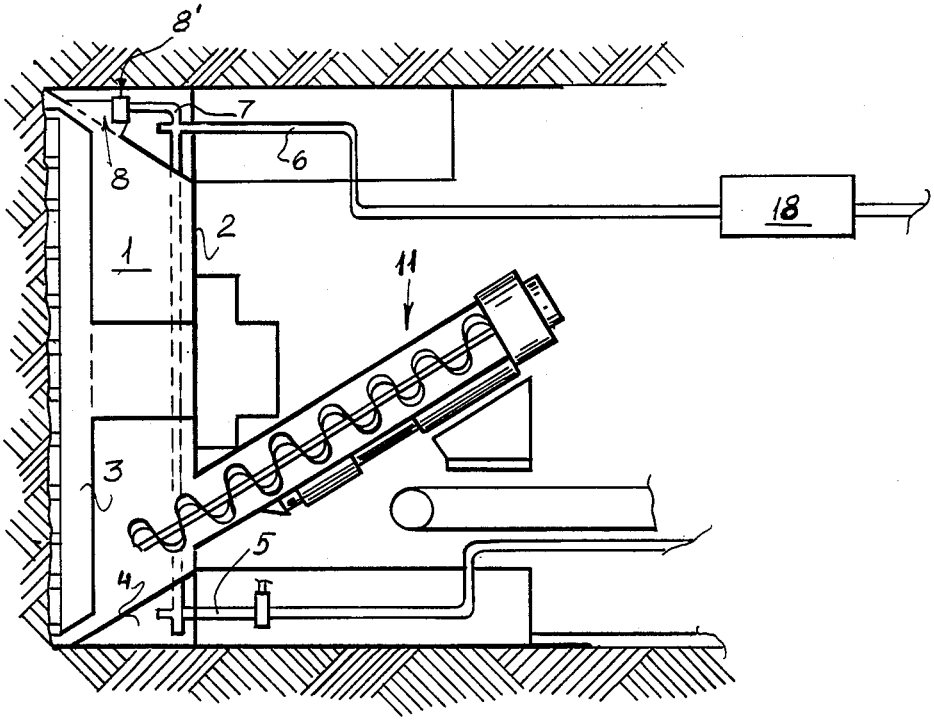
FIG. 1 is a longitudinal cross sectional view through one embodiment of an earth pressure shield according to our invention.

The earth pressure shield shown in the drawing has a front working compartment 1 which is formed by a separating partition and has a digging tool comprising a digging wheel 3. Directly behind the digging wheel 3 and/or directly in front of separating partition 2 there is an annular reinforcing space 4 which is triangular in cross section.

This annular reinforcing space 4 is provided with a lower liquid feeder 5 and an upper pressurized air feeder 6 controlled by a pressurized air control unit 18.

Figure 2:
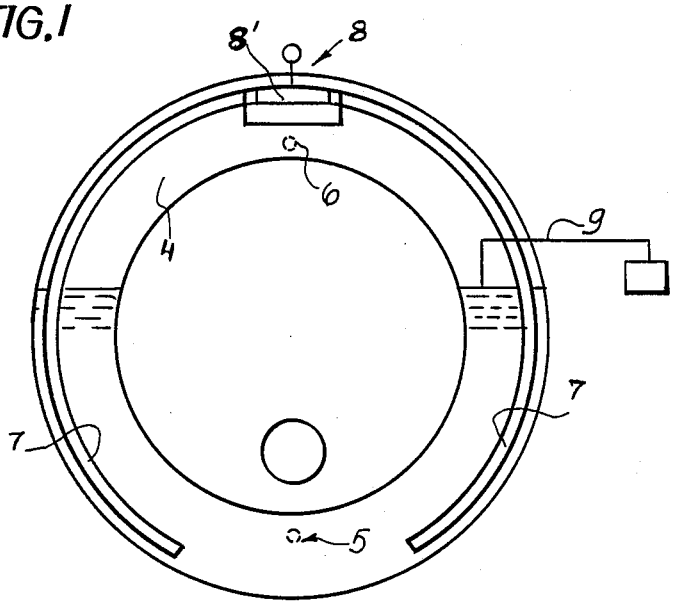
FIG. 2 is a front elevational view of the shield shown in FIG. 1 taken along line 2—2 with the digging tool removed.

As one can see directly from FIGS. 2 and/or 4 the annular reinforcing space 4 is also provided with liquid conductor pipes 7 generally as it were symmetrically. These pipes 7 extend from the lower half to an open upper liquid outlet 8 opening into the working compartment 1. In FIGS. 2 and/or 4 a liquid level controller 9 is indicated which holds the liquid level constant associated with the annular reinforcing space 4.

From FIGS. 1 and/or 3 it can be seen that the excavated earth can be removed with the help of a suction rake 10 and/or a screw conveyor 11 if necessary having a crusher 12 downstream from the working compartment 1.

In the embodiment according to FIGS. 1 and 2 the liquid necessary for support of the local front wall is pumped into the annular reinforcing space 4 with the triangular cross section which is positioned directly behind the shield excavator tool 3 and which usually acts to reinforce the excavator tool 3.

In the upper portion of this annular space 4 compressed air with a predetermined pressure is admitted or forced in. The compressed air control unit 18 provides for a constant pressure with only slight tolerances.

The liquid required for support of the local front wall is fed into the annular space 4 in the shield roof by the conductor pipe 7 and from there is forced into the working compartment 1 through the upper outlet 8.

The air pressure cushion in the annular reinforcing space 4 provides automatically that the pressure in the liquid remains constant also when larger amounts flow away through the liquid outlet 8 in the shield roof. The liquid level in the annular space 4 is monitored continuously with the level control unit 9 which controls the liquid feed. By the reliable, pressure stable feed of liquid in the vicinity of the roof the reliable safe support of the local front wall of the earth pressure shield is guaranteed.

In the embodiment according to FIGS. 3 and 4 the working compartment 1 connects under the liquid feeder 5 with the annular reinforcing space 4. Cross section reductions 13 of the annular reinforcing space 4 are provided on both sides in the lower quadrant. That segment 41 having a reduced cross section is closed at its lower end and that segment having a larger cross section is open at its lower end.

The upper liquid outlet 8 is closable for reasons to be described below and of course with aid of an upper liquid outlet valve 8' not described in detail. Moreover, the working compartment 1 has an additional liquid delivery 14 which is usable with liquid feeder 5 in the annular reinforcing space 4 closed and liquid outlet 8 closed.

As one can see necessarily from both FIGURES directly, the liquid feed device 14 has feed device outlets 15 directed downwardly into the working compartment 1, while the liquid feeder 5 has feeder outlets 16 directed upwardly into the annular reinforcing space 4 toward the liquid conductor pipes 7. Slide or gate valves 17 coupled with each other are positioned upstream of the feeder outlet 15 of the liquid feeder 5 and the feed device outlet 16 of the liquid delivery device 14.

The earth pressure shield described in FIGS. 3 and 4 is operated as follows: A liquid is pumped in the annular reinforcing space 4 through the liquid feeder 5. The feed device outlets 15 of the delivery device 14 directed downwardly are then transferred. The feeder outlets 16 are positioned at a fixed distance above the lower edge of the larger annular reinforcing space 4 for earth pressing action and directed upwardly.

As a result, it is guaranteed that the plastic base material of the working compartment 1 is not forced into the annular space 4 and the liquid feeder 5 clogged when the liquid, which should be maintained at a definite liquid level within certain bounds, is under a predetermined pressure from the pressure cushion in the upper portion of the annular space 4.

Thus the pressure of the pressure cushion is adjusted to the desired supporting pressure in the roof of the local front wall with the help of an air pressure regulator 18. The liquid required for support of the local front wall is guided to the shield roof through the conductor pipe 7 into the annular space 4 whose inlet is positioned above the feed device outlet 15 for the liquid feeder 5 and there is forced through the upper liquid outlet 8 in the working compartment 1.

The pressurized air cushion in the annular space provides automatic regulation of the pressure in the liquid to keep the pressure constant even when large amounts flow away through the upper liquid outlet 8 in the shield roof. The liquid level in the annular space 4 is monitored continuously with the level regulator 9 which controls the liquid feed. The earth material is withdrawn from the working compartment 1 with the screw conveyor 11 and fed to a piston pump 19 for a concentrate flow. Nearby the suction device or rake 10 is connected as a takeoff for the dilute flow.

For liquid operation after closing the upper liquid outlet 8 the supporting liquid is pumped by the liquid delivery device 14 into the working compartment 1 through the feed device outlets 15 directed downwardly toward the screw conveyor 11. The feeder outlets 16 directed upwardly into the annular space 4 are then unblocked.

An unblocked or hindered connection between the working compartment 1 and the annular reinforcing space 4 then exists through the downwardly open annular reinforcing space 4. In the upper portion of the annular space 4, a controlled pressurized air cushion as in earth pressing operations provides for a constant pressure on the liquid level. Thereby is ensured a controlled supporting pressure acting effectively on the liquid level. Also here the level regulator 9 observes the motion of the liquid level and controls the feed of liquid.

The loosened earth material is drawn together with the supporting liquid from the working compartment 1 by the suction device 10 and fed above ground in a dilute flow process. The screw conveyor 11 acts only as an inlet spacer device to feed the hard broken stone if necessary to the downstream crusher 12 which prepares the broken pumpable material for dilute flow transport. The piston pump 19 of the earth pressing operation is thus out of operation. The pipe conductor behind the pump can be used however for both transport processes—concentrate flow and dilute flow.

We claim:

1. In an earth pressure shield with a front working compartment formed by a separating wall having a digging tool and an annular reinforcing space substantially triangular in cross section positioned directly in front of said separating wall said annular reinforcing space having an upper and a lower half area, the improvement wherein said annular reinforcing space is provided with a liquid feeder in said lower half area, a regulated pressurized air feeder in said upper half area, a plurality of liquid conductor pipes each extending over an arc from said lower to said upper half area terminating in a liquid outlet opening into said working compartment and a liquid level controller.

2. The improvement defined in claim 1 wherein said liquid outlet is closable and said working compartment has a liquid delivery device which is adjustable with said liquid feeder closed in said annular reinforcing space with said liquid outlet closed.

3. The improvement defined in claim 2 wherein connections of said annular reinforcing space with said working compartment are made by cross section reductions on each side of said annular reinforcing space, one segment of said annular reinforcing space with the reduced cross section being closed at an upper end thereof and the other segment with the larger cross section having a lower end thereof open.

4. The improvement defined in claim 1 wherein said liquid outlet is closable with the help of a liquid outlet valve in said upper half area.

5. The improvement defined in claim 1 wherein said liquid delivery device of said working compartment has at least one feed device outlet directed downwardly.

6. The improvement defined in claim 2 wherein said liquid feeder has at least one feeder outlet directed upwardly in said annular reinforcing space.

7. The improvement defined in claim 2 wherein a slider valve is positioned upstream of a feeder outlet of said liquid feeder and another slider valve is positioned upstream of a delivery device outlet of said liquid feed device and said one slider valve is coupled with said other slider valve.

8. An earth pressure shield comprising:

a front working compartment formed by a separating wall;

a digging tool mounted in said front working compartment;

an annular reinforcing space substantially triangular in cross section having an upper and a lower half area and positioned directly in front of said separating wall provided with a liquid feeder in said lower half area, a regulated pressurized air feeder in said upper half area, a plurality of liquid conductor pipes each extending over an arc from said lower to said upper half area terminating in a liquid outlet opening into said working compartment and a liquid level controller, said liquid outlet being closable and said working compartment having a liquid delivery device which is adjustable with said liquid feeder closed in said annular reinforcing space and with said liquid outlet closed.

9. The improvement defined in claim 1 wherein said arc has a length which extends approximately 120°.

* * * * *